US006279433B1

(12) United States Patent
Chervenak

(10) Patent No.: US 6,279,433 B1
(45) Date of Patent: Aug. 28, 2001

(54) LOCKING PLIERS WITH EXTENDED GRIP

(75) Inventor: Thomas M. Chervenak, Beatrice, NE (US)

(73) Assignee: American Tool Companies, Inc., Hoffman Estates, IL (US)

( * ) Notice: Subject to any disclaimer, the term of this patent is extended or adjusted under 35 U.S.C. 154(b) by 0 days.

(21) Appl. No.: 09/459,671

(22) Filed: Dec. 13, 1999

(51) Int. Cl.[7] ..... B25B 7/00
(52) U.S. Cl. ..... 81/427.5; 81/367; 81/177.2
(58) Field of Search ..... 81/367–384, 427.5, 81/177.2, 388–390, 398–399, 184, 180.1

(56) References Cited

U.S. PATENT DOCUMENTS

| | | | |
|---|---|---|---|
| 483,461 | | 9/1892 | Litel . |
| 2,377,612 | | 6/1945 | Clark . |
| 3,672,245 | | 6/1972 | Hoffman . |
| 4,519,278 | * | 5/1985 | Heldt ..... 81/427.52 |
| 4,709,601 | | 12/1987 | Petersen . |
| 5,253,557 | | 10/1993 | Dolak . |
| 5,351,585 | | 10/1994 | Leseberg et al. . |
| 5,456,144 | | 10/1995 | Dahl et al. . |
| 5,595,100 | | 1/1997 | Sollo . |
| 5,735,353 | | 4/1998 | Undin . |
| 5,758,729 | | 6/1998 | Undin . |

* cited by examiner

*Primary Examiner*—D. S. Meislin
(74) *Attorney, Agent, or Firm*—Brinks Hofer Gilson & Lione

(57) ABSTRACT

A locking pliers includes a body that supports a fixed jaw and a movable jaw. A lever is pivotably connected to the movable jaw, and a locking mechanism including a stub arm is coupled between the body and the lever to lock the jaws in a closed position. This locking mechanism includes an adjustment screw that is exposed at an end of the body remote from the fixed jaw. The body forms a resilient gripping surface that extends away from the exposed portion of the adjustment screw. This gripping surface extends beyond the end of the lever by at least about 4 inches such that the lever does not obstruct access to the grip. The user can place both hands on the grip to apply large torques to a clamped workpiece once the locking pliers has been locked in place on the workpiece.

3 Claims, 2 Drawing Sheets

LOCKING PLIERS WITH EXTENDED GRIP

BACKGROUND

This invention relates to locking pliers, and in particular to an improved locking pliers that is well-suited to apply large torques to a workpiece locked in the pliers.

Various types of locking pliers are well-known to those skilled in the art. See, for example, U.S. Pat. Nos. 5,351,585, 5,456,144 and 4,709,601, all assigned to the assignee of the present invention. Such locking pliers include an over-center toggle linkage that operates when closed to lock a movable jaw in an adjustable position with respect to a fixed jaw. Once the over-center toggle linkage has been closed, the locking pliers remains locked onto a workpiece, even if the user releases the pliers completely.

The locking pliers shown in U.S. Pat. No. 5,351,585 includes large capacity jaws and is well-suited for use in plumbing and other applications where large torques are applied to the clamped workpiece. In such applications, it would on occasion be advantageous if the locking pliers provided a larger torque arm. However, if the locking pliers shown in U.S. Pat. No. 5,351,585 were simply enlarged in scale, the enlarged pliers would be excessively heavy and awkward to use for many applications.

The present inventor is aware that pipes on occasion have been secured to the body of a locking pliers in order to provide an extended body. Such pipes are commonly known as cheater bars in other applications. Pipes of this type provide the disadvantage that they fit around the adjustment screw and that they are separate pieces. It is therefore not possible to adjust the closed position of the movable jaw with the adjustment screw when a pipe of the type described above is positioned on the body of the locking pliers.

Thus, a need presently exists for an improved locking pliers that overcomes the disadvantages discussed above.

BRIEF SUMMARY

By way of introduction, the preferred embodiments described below are locking pliers having an over-center locking mechanism, a lever, and a body that forms an extended grip. This grip extends substantially beyond the outermost end of the lever, and the grip is configured such that the adjustment screw of the over-center locking mechanism is readily accessible. Preferably, the grip is covered with a resilient cushioning element to improve the ergonomics of the grip.

Because the elongated body extends beyond the lever, the lever does not obstruct access to the handle. A user can clamp the locking pliers on the workpiece in the conventional manner of a small locking pliers and then place one or both hands on the grip to apply large torques to the workpiece.

The foregoing paragraphs have been provided by way of introduction, and they are not intended to limit the scope of the following claims.

DETAILED DESCRIPTION OF THE PRESENTLY PREFERRED EMBODIMENTS

Figure 1:
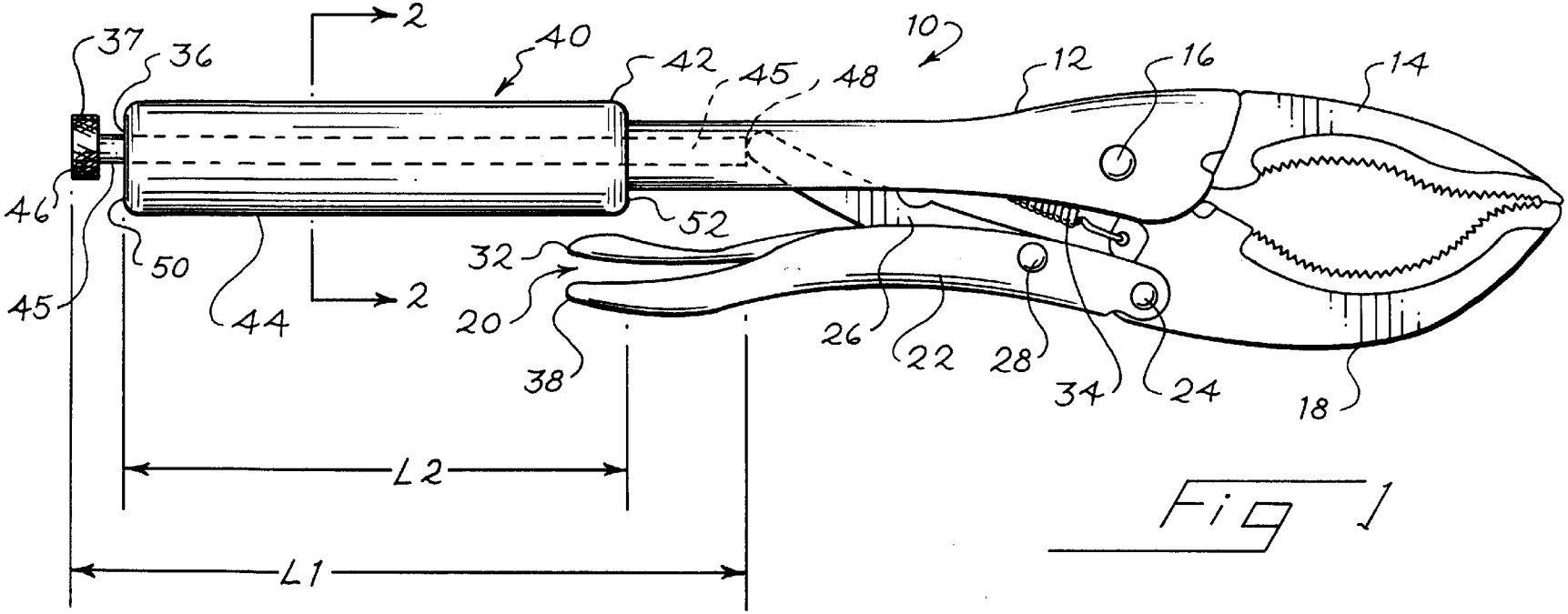
FIG. 1 is a side view in partial cutaway of a locking pliers that incorporates a preferred embodiment of this invention.

As shown in FIG. 1, a locking pliers 10 includes a body 12 that rigidly supports a fixed jaw 14 and defines a pivot axis 16. A movable jaw 18 is pivotably mounted to the body 12 to pivot about the pivot axis 16. The position of the movable jaw 18 with respect to the fixed jaw 14 is controlled by a lever 22 that is pivotably mounted to the movable jaw 18 at a pivot axis 24, and a locking mechanism such as an over-center toggle linkage 20. The linkage 20 includes a compression member such as a stub arm 26 that is pivotably mounted to the lever 22 at a pivot axis 28. A release lever 32 is pivotably mounted to the lever 22 to bear on the stub arm 26. A coil spring 34 operates as an extension spring to bias the movable jaw 18 to an open position.

The lever 22 and the stub shaft 26 operate to move the movable jaw 18 to a closed position when the lever 22 is moved generally parallel to the body 12. As used herein, the closed position of the jaw 18 is any position used to clamp a workpiece against the fixed jaw 14. The closed position of the jaw 18 can include any of a range of relative spacings between the fixed and movable jaws 14, 18, depending on the size of the workpiece.

Many alternative forms of the elements 14–34 described above can be used, and these elements can be entirely conventional, if desired. For example, the elements 14–34 may all be formed as described in U.S. Pat. No. 5,351,585, assigned to the assignee of the present invention and hereby incorporated by reference in its entirety. The locking mechanism is not limited to the toggle linkage shown in FIG. 1, and the pivot axis 16 may be made movable with respect to the body 12. See, for example, the alternative linkage and pivot arrangement disclosed in Hoffman U.S. Pat. No. 3,672,245.

Figure 2:
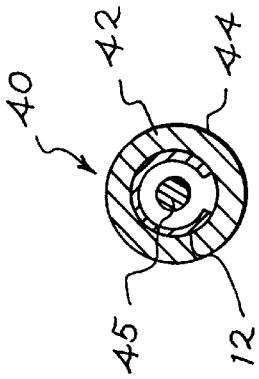
FIG. 2 is a cross sectional view taken a long line 2—2 of FIG. 1.

The locking pliers 10 of FIG. 1 departs from the locking pliers of U.S. Pat. No. 5,351,585 in that the first end 36 of the body 12 extends substantially beyond the second end 38 of the lever 22. The portion of the body 12 that extends beyond the second end 38 of the lever 22 forms a grip 40 that in this embodiment is surrounded by a resilient cushioning element 42 (FIG. 2). The cushioning element 42 forms a resilient gripping surface 44 that extends substantially beyond the lever 22. For example, the cushioning element 42 may be formed of a thermoplastic elastomer such as the material sold by Monsanto under the tradename SANTOPRENE.

The first end 36 of the body 12 is threaded to receive an adjustment screw 45. The adjustment screw 45 extends through a central portion of the grip 40 generally parallel to the grip 40, the resilient element 42 and the resilient gripping surface 44. The adjustment screw 45 defines a exposed outer end 37 that in this embodiment is knurled and an inner end 48 that is configured to bear against the end of the stub arm 26. The user can adjustably position the adjustment screw 45 in the body 12, thereby adjusting the position of the end of the stub arm 26 and the position of the movable jaw 18 when the lever 22 is moved to the closed position of FIG. 1.

The grip 40 defines first and second ends 50, 52, and in this embodiment the length L1 of the adjustment screw 45 between the outer and inner ends 46, 48 is greater than the length L2 of the grip 40 between the ends 50, 52.

In operation, a user positions a workpiece (not shown) between the jaws 14 and 18, and then moves the lever 22 to the closed position shown in FIG. 1 in order to clamp the workpiece between the jaws 14, 18. The user can adjust the closed position of the jaw 18 by rotating the screw 45 to properly the position the inner end 48 prior to closing the lever 22. The grip 40 in no way interferes with conventional use of the adjustment screw 45. Because the adjustment screw 45 is longer than the grip 40, the locking pliers can be operated in the conventional manner, and the resilient element 42 does not have to be removed in order to allow adjustment of the locking pliers.

Once the locking pliers has been closed, the user can then place one or both hands on the gripping surface 44 in order to apply large torques to the workpiece. Note that the user can grasp the gripping surface 44 without obstruction from the lever 22, because the grip 44 extends substantially beyond the lever 22. In this preferred embodiment, the grip 40 extends at least about 4 inches and most preferably about 5 inches beyond the second end 38 of the lever 22.

The locking pliers 10 provides the advantage that it is unusually light in weight for a given torque arm. This is because the grip 40 extends substantially beyond the lever 22, and the lever 22 is therefore not made unnecessarily large, cumbersome and heavy. Rather, the grip 40 is built to a larger scale than the lever 22, and the grip 40 and the lever 22 are each properly sized for their respective intended uses.

Of course, many changes and modifications can be made to the preferred embodiment described above. The grip 40 may be formed of a non-resilient material, or resilient material may extend partially over the grip 40. As pointed above, many changes can be made to the jaws 14, 18, body 12 and locking mechanism. For example, the movable jaw 18 can be pivotably mounted to the fixed jaw 14 rather than to the handle 12. The shapes of the jaws 14, 18 can be varied widely, depending upon the application, as can the overall size of the locking pliers and its proportions.

Figure 3:
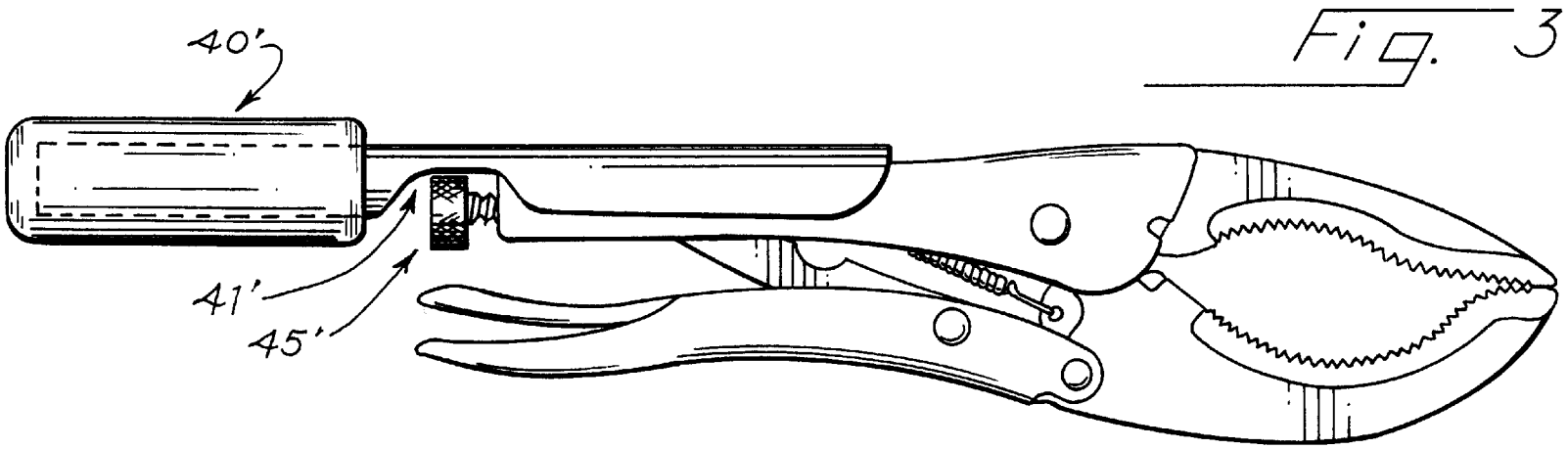
FIG. 3 is a side view of an alternative embodiment of the locking pliers of this invention.

Another alternative, as shown in side view in FIG. 3, differs from the first preferred embodiment described above in that the screw 45' does not protrude out the end of the grip 40'. Preferably two opposed windows are shown, and only one appears in FIG. 3. The adjustment screw 45' is relatively short, and the head of the adjustment screw 45' is exposed at the window 41' for rotation by the user. The embodiment of FIG. 3 can be used in substantially the same manner as that described above. The extended grip 40' does not interfere with user rotation of the screw 45' to adjust the closing position of the locking pliers. The shorter adjusting screw 45' reduces the weight and the cost of the locking pliers of FIG. 3.

Figure 4:
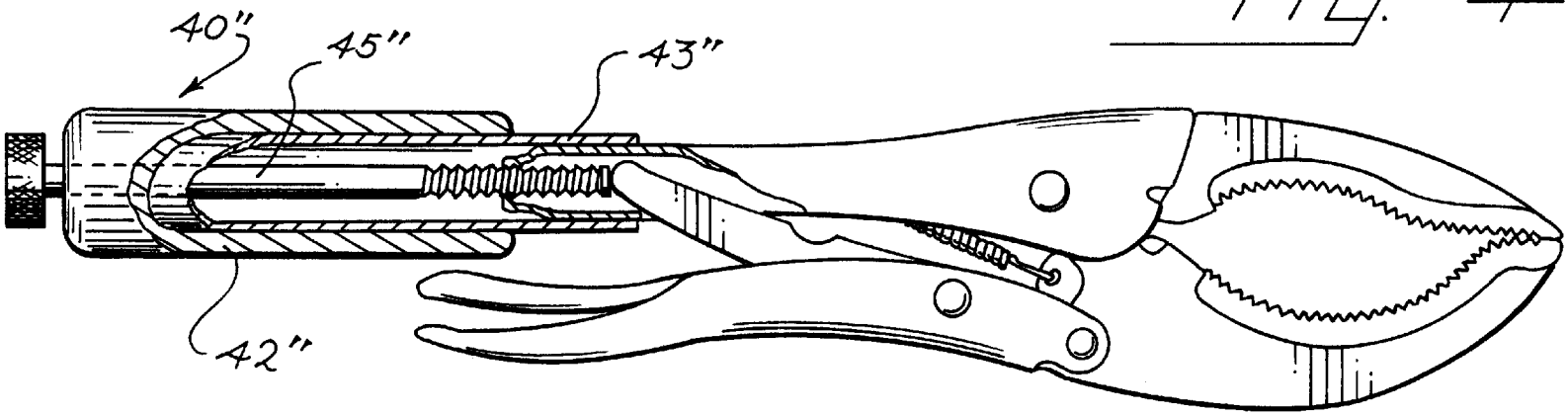
FIG. 4 is a side view in partial cutaway of another alternative embodiment of the locking pliers of this invention.

As another alternative, the adjusting screw 45" can include a reduced diameter, unthreaded shank between the head and the threaded portion that engages the body of the locking pliers, as shown in FIG. 4. This is another approach to reducing the weight and cost of the locking pliers. In FIG. 4, the grip 40" includes a tubular extension 43" that is brazed or welded to a conventional body. A resilient cushioning element 42", similar to that described above, is provided.

It is therefore intended that the foregoing detailed description be regarded as illustrative rather than limiting. It is only the following claims, including all equivalents, that are intended to define the scope of this invention.

What is claimed is:

1. A locking pliers comprising:

a body;

a first jaw coupled with a body;

a second jaw coupled with a lever, said lever comprising an end remote from the second jaw;

a locking mechanism coupled between the body and the lever to lock the jaws in a closed position, said locking mechanism comprising an adjustment screw exposed adjacent the body;

said body comprising a resilient grip extending substantially around the body, said grip shaped to provide access to the adjustment screw and to extend beyond the lever to allow a user to grasp the grip without obstruction by the lever, said adjustment screw being longer than said grip.

2. The invention of claim 1 wherein the grip comprises two ends, and wherein the adjustment screw extends through both ends of the grip.

3. The invention of claim 1 wherein the grip extends beyond the end of the lever by at least about 4 inches when the lever is positioned adjacent to the body.

* * * * *